US007926579B2

(12) United States Patent
Sbordone et al.

(10) Patent No.: US 7,926,579 B2
(45) Date of Patent: Apr. 19, 2011

(54) APPARATUS FOR SUBSEA INTERVENTION

(75) Inventors: Andrea Sbordone, Venice (IT); Rene Schuurman, Singapore (SG)

(73) Assignee: Schlumberger Technology Corporation, Sugar Land, TX (US)

( * ) Notice: Subject to any disclaimer, the term of this patent is extended or adjusted under 35 U.S.C. 154(b) by 870 days.

(21) Appl. No.: 11/764,881

(22) Filed: Jun. 19, 2007

(65) Prior Publication Data

US 2008/0314597 A1 Dec. 25, 2008

(51) Int. Cl.
*E21B 29/12* (2006.01)
*E21B 7/12* (2006.01)

(52) U.S. Cl. ..... 166/384; 166/346; 166/359; 166/367; 166/77.2; 405/168.3

(58) Field of Classification Search ..... 166/359, 166/367, 335, 346, 349–352, 77.1, 77.2, 166/384; 405/224.2, 166, 168.3; 45/224.4
See application file for complete search history.

(56) References Cited

U.S. PATENT DOCUMENTS

| | | | | |
|---|---|---|---|---|
| 4,730,677 | A | 3/1988 | Pearce et al. | |
| 5,749,676 | A * | 5/1998 | Head | 405/171 |
| 5,778,981 | A * | 7/1998 | Head | 166/345 |
| 5,826,654 | A * | 10/1998 | Adnan et al. | 166/250.01 |
| 6,062,769 | A * | 5/2000 | Cunningham | 405/195.1 |
| 6,102,125 | A * | 8/2000 | Calder | 166/359 |
| 6,116,345 | A * | 9/2000 | Fontana et al. | 166/343 |
| 6,161,619 | A * | 12/2000 | Head | 166/355 |
| 6,192,983 | B1 * | 2/2001 | Neuroth et al. | 166/250.15 |
| 6,321,596 | B1 * | 11/2001 | Newman | 73/152.45 |
| 6,386,290 | B1 * | 5/2002 | Headworth | 166/346 |
| 6,558,215 | B1 * | 5/2003 | Boatman | 441/5 |
| 6,691,775 | B2 * | 2/2004 | Headworth | 166/77.2 |
| 6,725,924 | B2 * | 4/2004 | Davidson et al. | 166/250.01 |
| 6,745,840 | B2 * | 6/2004 | Headworth | 166/346 |
| 6,834,724 | B2 * | 12/2004 | Headworth | 166/384 |
| 6,843,321 | B2 * | 1/2005 | Carlsen | 166/355 |
| 7,025,533 | B1 * | 4/2006 | Mungall et al. | 405/158 |
| 7,080,689 | B2 * | 7/2006 | Guesnon et al. | 166/355 |
| 7,150,324 | B2 * | 12/2006 | Laursen et al. | 166/355 |
| 7,156,583 | B2 * | 1/2007 | Masetti et al. | 405/158 |
| 7,234,524 | B2 * | 6/2007 | Shaw et al. | 166/304 |
| 7,270,185 | B2 * | 9/2007 | Fontana et al. | 166/358 |
| 7,431,092 | B2 * | 10/2008 | Haheim et al. | 166/343 |
| 7,628,206 | B2 * | 12/2009 | Bhat et al. | 166/355 |
| 7,669,660 | B1 * | 3/2010 | Murray et al. | 166/345 |
| 7,685,892 | B2 * | 3/2010 | Hoen | 73/862.391 |
| 7,798,232 | B2 * | 9/2010 | Headworth | 166/352 |
| 2002/0079108 | A1 * | 6/2002 | Headworth | 166/384 |
| 2002/0092655 | A1 * | 7/2002 | Fincher et al. | 166/370 |
| 2005/0063788 | A1 * | 3/2005 | Clausen | 405/224.2 |
| 2005/0189115 | A1 * | 9/2005 | Rytlewski et al. | 166/344 |
| 2005/0217844 | A1 * | 10/2005 | Edwards et al. | 166/85.1 |

(Continued)

FOREIGN PATENT DOCUMENTS

| | | |
|---|---|---|
| GB | 2145135 | 3/1985 |
| GB | 2297337 A | 7/1996 |
| WO | 00/43632 | 7/2000 |

*Primary Examiner* — Thomas A Beach

(57) ABSTRACT

A technique for monitoring and evaluating parameters related to the use of a compliant guide system in intervention operations. A compliant guide enables movement of a conveyance within its interior and is coupled between a subsea installation and a surface vessel. A sensor system is provided with sensors deployed in subsea locations to detect operational parameters related to operation of the compliant guide. A control system is coupled to the sensor system to receive data output from the sensor system.

26 Claims, 6 Drawing Sheets

U.S. PATENT DOCUMENTS

2007/0175639 A1* 8/2007 Hoen ..... 166/336
2008/0105432 A1* 5/2008 Zemlak et al. ..... 166/336
2008/0185152 A1* 8/2008 Sbordone et al. ..... 166/341
2008/0264643 A1* 10/2008 Skeels et al. ..... 166/348
2008/0277122 A1* 11/2008 Tinnen ..... 166/339
2009/0078424 A1* 3/2009 Carossino et al. ..... 166/341
2009/0183881 A1* 7/2009 Sbordone ..... 166/335

* cited by examiner

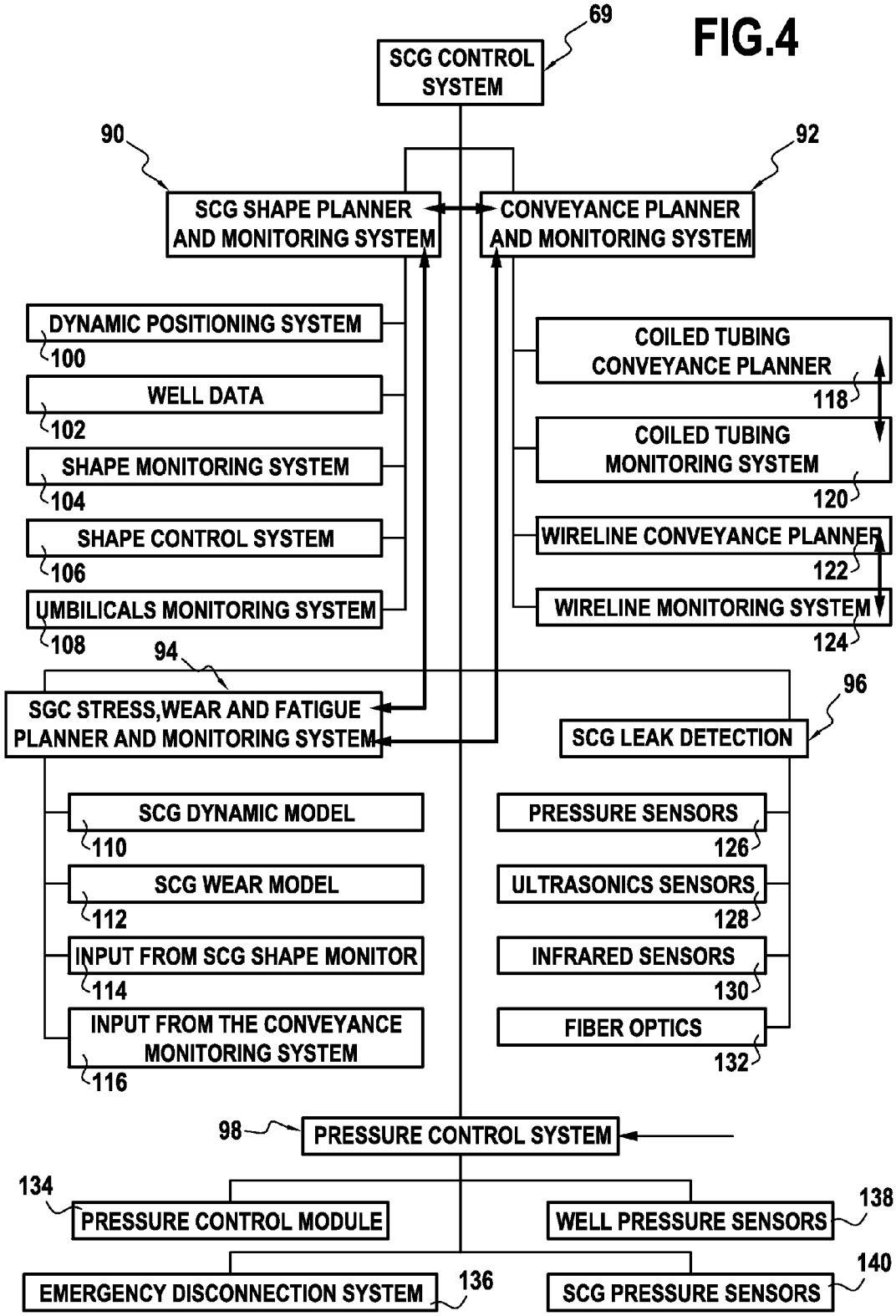
FIG.4
SCG CONTROL SYSTEM
69
90
92
SCG SHAPE PLANNER AND MONITORING SYSTEM
CONVEYANCE PLANNER AND MONITORING SYSTEM
DYNAMIC POSITIONING SYSTEM
100
WELL DATA
102
SHAPE MONITORING SYSTEM
104
SHAPE CONTROL SYSTEM
106
UMBILICALS MONITORING SYSTEM
108
COILED TUBING CONVEYANCE PLANNER
118
COILED TUBING MONITORING SYSTEM
120
WIRELINE CONVEYANCE PLANNER
122
WIRELINE MONITORING SYSTEM
124
94
96
SGC STRESS,WEAR AND FATIGUE PLANNER AND MONITORING SYSTEM
SCG LEAK DETECTION
SCG DYNAMIC MODEL
110
SCG WEAR MODEL
112
INPUT FROM SCG SHAPE MONITOR
114
INPUT FROM THE CONVEYANCE MONITORING SYSTEM
116
PRESSURE SENSORS
126
ULTRASONICS SENSORS
128
INFRARED SENSORS
130
FIBER OPTICS
132
98
PRESSURE CONTROL SYSTEM
134
PRESSURE CONTROL MODULE
WELL PRESSURE SENSORS
138
EMERGENCY DISCONNECTION SYSTEM
136
SCG PRESSURE SENSORS
140

APPARATUS FOR SUBSEA INTERVENTION

BACKGROUND

Subsea intervention operations require a safe and controlled manner of entering a subsea installation with an intervention tool string, while containing the pressurized borehole fluids to prevent their escape in to the sea. Several methods of intervention exist, employing fixed platforms, semi-submersible rigs, floaters, drill ships, and/or other dynamically positioned vessels. However, the high costs and low availability of large intervention structures has induced the industry to look for technologies that enable intervention operations from smaller, cheaper and more available vessels.

A spoolable compliant guide has been proposed for use in subsea intervention operations. A spoolable compliant guide is constructed as a hollow tube that may be continuous or joined. The guide acts as a conduit for the passage of coiled tubing between a surface vessel and a subsea wellhead. Such alternate systems, however, are exposed to a variety of induced stresses that can lead to material fatigue. Existing methods and systems for predicting, monitoring, and/or evaluating the stresses and operating envelopes of the system during intervention operations are not satisfactory.

SUMMARY

In general, the present invention provides an improved method and system for monitoring and evaluating parameters related to the use of a compliant guide system in an intervention operation. A compliant guide, such as a spoolable compliant guide is coupled between a subsea installation and a surface vessel. The compliant guide is configured for movement of a conveyance within its interior. A sensor system is provided with sensors deployed in subsea locations to detect operational parameters related to operation of the compliant guide. A control system is coupled to the sensor system to receive data output from the sensor system. The data can be used for a variety of monitoring, modeling, real-time evaluation, and/or evaluations that improve the operational longevity and efficiency of the compliant guide intervention system.

BRIEF DESCRIPTION OF THE DRAWINGS

Certain embodiments of the invention will hereafter be described with reference to the accompanying drawings, wherein like reference numerals denote like elements, and:

FIG. 4 is a schematic illustration of one embodiment of an observation and control architecture, according to an embodiment of the present invention;

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a technique for intervening in subsea installations, such as subsea wells. The technique also provides unique ways of utilizing an intervention system having a compliant guide, such as a spoolable compliant guide, and a control and sensing system. The control and sensing system enables, for example, the detection and monitoring of parameters related to intervention operations. The control and sensing system also can be used in controlling and/or modeling of the intervention system in a variety of subsea environments.

Having a compliant guide deployed in open waters between a surface vessel and a subsea installation can expose the compliant guide to several different stresses and wearing agents. The stresses and wearing agents can affect the integrity of the guide and its capacity to perform according to its design specifications. Furthermore, the shape of the compliant guide itself can affect conveyance capabilities and other operational parameters that are impacted on a real-time basis during an intervention operation.

As described in greater detail below, the control and sensor system comprises sensors that can be used in monitoring relevant parameters and in detecting the occurrence of parameter value deviation from a desired range. Sensors can be utilized in subsea positions to directly monitor compliant guide parameters as well as parameters of other associated equipment. By way of example, the sensors can be used to monitor compliant guide integrity, e.g. to detect leaks. The sensors also can be used to monitor and/or control the shape of the compliant guide. Sensors also can be used to detect desired parameters related to other supporting equipment, such as subsea installations, conveyances, umbilicals and other intervention equipment.

Figure 1:
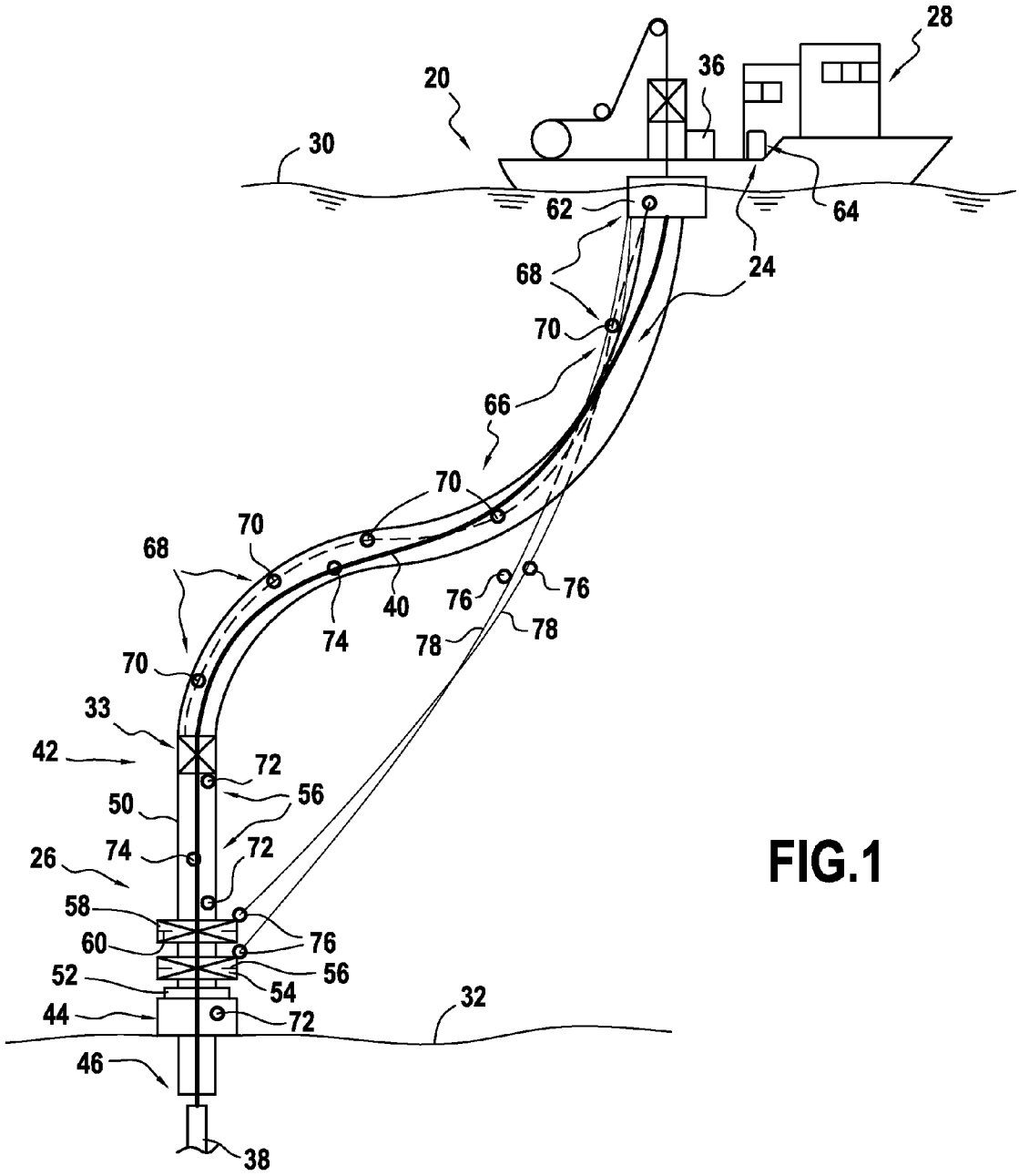
FIG. 1 is a schematic front elevation view of a subsea intervention system, according to an embodiment of the present invention.

Referring generally to FIG. 1, one example of an intervention system utilizing a compliant guide in combination with a control and sensor system is illustrated. In this embodiment, an intervention system 20 comprises a compliant guide 22, e.g. a spoolable compliant guide, and a control and sensor system 24. Compliant guide 22 is coupled between a subsea installation 26 and a surface vessel 28, such as an intervention vessel located at a surface 30 of the sea. Subsea installation 26 may be located on or at a seabed floor 32. In some applications, pressure in the compliant guide 22 can be selectively adjusted to assist intervention operations involving, for example, pulling out of the well or running into the well. The system 20 also may utilize a dynamic seal 33 positioned at or proximate a lower end of compliant guide 22.

Compliant guide 22 is flexible and may be arranged in a variety of curvilinear shapes extending between a surface location, e.g. intervention vessel 28, and subsea installation 26. Furthermore, compliant guide 22 may be constructed as a tubular member formed from a variety of materials that are sufficiently flexible, including metal materials, of appropriate cross-section, and composite materials.

In some applications pressure is controlled within the compliant guide 22 to create the desired pressure differential acting on dynamic seal 33. Pressure control may be facilitated by filling compliant guide 22 with a buffer fluid 34, such as seawater, introduced into the interior of compliant guide 22. In some applications, other buffer fluids 34 can be used, e.g. environmentally friendly greases for friction reduction or for pressure sealing; fluids designed for hydrate prevention; weighted mud; and other appropriate buffer fluids. The level and pressure of buffer fluid 34 can be controlled from the surface by, for example, standard hydraulic pressure control equipment 36 that may be mounted on intervention vessel 28.

An intervention tool string 38 may be deployed by a conveyance 40. The compliant guide 22 and dynamic seal 33 accommodate many different types of conveyances 40. For example, conveyance 40 may be a flexible, cable-type conveyance, such as a wireline or slickline. However conveyance 40 also may comprise stiffer mechanisms including coiled tubing and coiled rod. When a cable-type conveyance 40 is used to convey intervention tool string 38, compliant guide 22 can be arranged to facilitate passage of the intervention tool string 38 without requiring a pushing force, at least in some applications. In other words, the curvilinear configuration of compliant guide 22 is readily adjustable via, for example, locating intervention vessel 28 so as to avoid bends or deviated sections that could interfere with the passage of intervention tool string 38. Control over the shape of compliant guide 22 as well as detection and monitoring of compliant guide parameters can be accomplished with control and sensor system 24, as described in greater detail below. The control and sensor system 24 also can be used to monitor other equipment, such as subsea installation 26.

Subsea installation 26 may have a variety of forms depending on the particular environment and type of intervention operation. In FIG. 1, for example, the subsea installation 26 comprises a subsea wellhead 44, which may include a Christmas tree, coupled to a subsea well 46. Dynamic seal 33 may be positioned generally at the bottom of compliant guide 22 to help block incursion of well fluids into an interior 48 of the compliant guide. In other embodiments, dynamic seal 33 may be positioned proximate compliant guide 22 in, for example, subsea installation 26.

In the embodiment illustrated, subsea installation 26 comprises a subsea lubricator 50 and a variety of other components. For example, the subsea installation comprises a lubricating valve 52 that may be deployed directly above subsea wellhead 44. Lubricating valve 52 can be used to close the borehole of subsea well 46 during certain intervention operations, such as tool change outs. A blowout preventer 54 may be positioned above lubricating valve 52 and may comprise one or more cut-and-seal rams 56 able to cut through the interior of the subsea installation and seal off the subsea installation during an emergency disconnect. The subsea installation 26 also may comprise a second blowout preventer 58 positioned above blowout preventer 54 and comprising one or more sealing rams 60 able to seal against the conveyance 40. Many other components, e.g. an emergency disconnect device 62, also can be incorporated into intervention system 20 depending on the specific intervention application.

Many of these components as well as many aspects of the intervention operation can be monitored and controlled via system 24. By way of example, control and sensor system 24 comprises a control system 64 and a sensor system 66. Sensor system 66 comprises a plurality of sensors 68 located at subsea positions to sense selected parameters related to the intervention operation and/or the operation of specific components, such as compliant guide 22. Depending on the application, sensor 68 may comprise temperature sensors, flow sensors, pressure sensors, ultrasonic sensors, sonics sensors, strain sensors, infrared sensors, distributed sensors, e.g. distributed temperature sensors, or other sensors designed to sense desired parameters.

In the embodiment illustrated, sensors 68 comprise a plurality of compliant guide sensors 70 positioned at subsea locations to detect parameters related to operation of the compliant guide 22. Compliant guide sensors 70 can be used to determine whether compliant guide 22 is operating such that specific parameters are within a desired range. For example, compliant guide sensors 70 can be used to detect the occurrence of an excess parameter deviation indicative of a problem or potential problem. Some of the detected parameters may relate to stresses along the compliant guide and wearing agents that can affect the integrity of compliant guide 22 as well as its capacity to perform according to its design specifications. The sensors 70 can also be used to monitor the shape of the compliant guide which can affect not only the stresses applied to the compliant guide but also the ability to convey tool strings through the compliant guide and otherwise utilize the compliant guide for its intended purposes.

Sensors 68 may also comprise subsea installation sensors 72 which can be used to sense various parameters of and in subsea installation 26. In some applications, sensor 68 also may comprise one or more conveyance sensors 74 located to sense conveyance related parameters, e.g. stress, strain or position, of conveyance 40. Sensor 68 may also comprise other component sensors, such as umbilical sensors 76 positioned to sense parameters related to the operation of one or more umbilicals 78. Umbilicals 78 can be used to control a variety of subsea installation functions as well as functions of other subsea components. By way of example, umbilical sensors 76 may be position sensors that monitor the location of a given umbilical during or after the umbilical is connected for operation.

The various sensors 68 can comprise a variety of sensor types, including distributed temperature sensors. For example, distributed temperature or pressure sensors can be deployed along compliant guide 22 and/or conveyance 40. The various sensors may be integrated into control and sensor system 24 to facilitate not only the detection and monitoring of specific intervention related parameters, but also to facilitate control over the operation of the various intervention components, e.g. compliant guide 22. Additionally, the data collected from sensors 68 can be used in modeling various aspects of the intervention operation, the functionality of individual components, component fatigue, component life, and other operational aspects.

Figure 2:
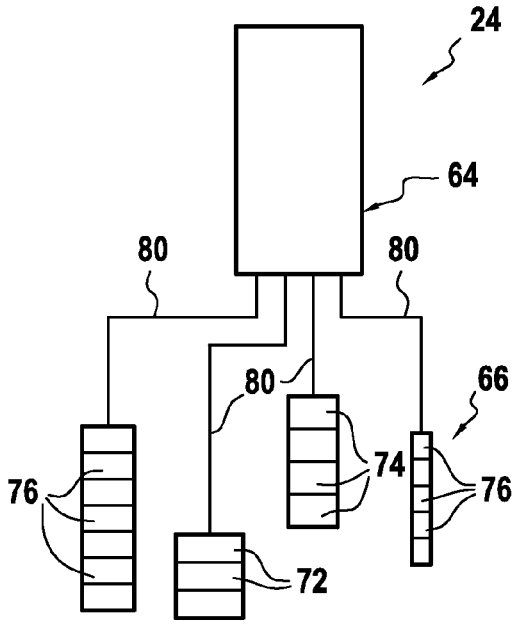
FIG. 2 is a schematic illustration of a control and sensing system, according to an embodiment of the present invention.

Referring generally to FIG. 2, a schematic representation of control and sensor system 24 is illustrated. As illustrated, control system 64 is operatively coupled to sensor system 66 by appropriate communication lines 80 which can be wireless lines, electrical lines, fiber optic lines, or other types of suitable communication lines. Communication lines 80 transfer data between the system sensors (e.g. compliant guide sensors 70, subsea installation sensors 72, conveyance sensors 74, umbilical sensors 76) and the control system 64.

Figure 3:
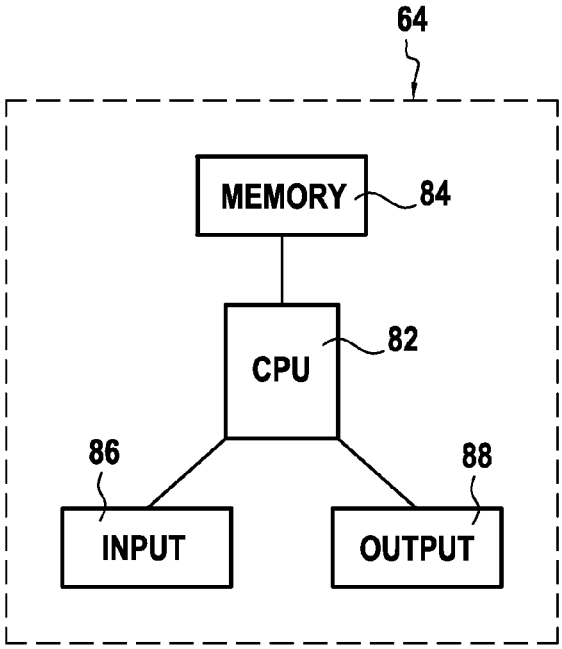
FIG. 3 is a schematic illustration of one embodiment of a computer-based control system that can be utilized in the subsea intervention system, according to an embodiment of the present invention.

Control system 64 may be designed and constructed in a variety of forms to carry out the sensing and controlling functions related to a given intervention operation. In one example, control system 64 comprises an automated, computer-based system as illustrated in FIG. 3. In this embodiment, control system 64 comprises a central processing unit (CPU) 82. CPU 82 is operatively coupled to a memory 84 as well as an input device 86 and an output device 88. Input device 86 may comprise a variety of devices, such as a keyboard, mouse, voice-recognition unit, touchscreen, other input devices, or combinations of such devices. Output device 64 may comprise a visual and/or audio output device, such as a monitor having a graphical user interface. The output device 64 is designed to provide information to a system operator. The processing of data inputs and outputs can be done on a single device or multiple devices positioned at the well location, away from the well location, or with some devices located at the well and other devices located remotely.

The control architecture implemented on control system 64, e.g., a computer-based control system, can be software-based and can vary according to the sensors utilized or available. The architecture also may be designed in a variety of ways depending on the desired parameter detection, parameter monitoring, control capabilities, and modeling capabilities desired for given intervention operations. One embodiment of a control architecture is illustrated in FIG. 4. In this illustrated embodiment, control system 64 comprises a spoolable compliant guide shape planner and monitoring system module 90; a conveyance planner and monitoring system module 92; a spoolable compliant guide stress, wear and fatigue planner and monitoring system module 94; a spoolable compliant guide leak detection module 96; and a pressure control system module 98. Other modules or alternate modules can be used depending on a variety of factors, such as subsea well environment, intervention system components, and desired system capabilities.

In the embodiment illustrated in FIG. 4, the control system architecture enables an operator to plan, simulate and define the desired configuration of the intervention system 20 for a selected operation. For example, an operator can plan, simulate and defined a desired position of surface vessel 28 and its potential operating envelope. The operator also can determine the optimal shape of the spoolable compliant guide as well as the shape operating envelope. The operator also can determine tool conveyance limits and conveyance stresses expected as well as the need for auxiliary conveyance methods, e.g. tractors, pump-down rollers, or other auxiliary methods. The system also allows the operator to determine the need for temporary changes of surface vessel position and spoolable compliant guide shape to facilitate the conveyance of the intervention tool string 38 through the bends of the spoolable compliant guide 22. The various system control modules also allow the operator to monitor the actual shape of the guide and the stresses it experiences due to the actual shape and due to the effect of the conveyance running inside compliant guide 22. The control system modules also enable an operator to monitor the integrity of the guide, e.g. determine the leaks, and the actual status of pressure control system 36.

The control system 64 and the individual control system modules can be designed for real-time monitoring of the overall intervention system and/or specific components of the intervention system. Based on this data, real-time decisions can be made with respect to surface vessel position and orientation, pressure control contingency plans in case of leaks, tool deployment, emergency disconnects, and other contingency plans. Furthermore, the data can be collected in, for example, memory 84 to maintain a continuously updated history of the stresses incurred by each intervention system component. The updated history is useful in determining damage to a component or in estimating the remaining life of a component. For example, if a measured parameter or parameters moves outside of an acceptable range, appropriate actions can be taken to maintain or replace the problematic components.

The various control system modules can be designed to operate largely independently or interactively with each other depending on the desired functionality. The spoolable compliant guide shape planner and monitoring system module 90 incorporates a variety of system sub-modules, such as a dynamic positioning system sub-module 100, a well data sub-module 102, a shape monitoring system sub-module 104, a shape control system sub-module 106, and an umbilicals monitoring system sub-module 108. The spoolable compliant guide shape planner and monitoring system module 90 also allows, for example, an operator to enter parameters via input device 86 such as water depth, spoolable compliant guide length, weight of fluid 34, buoyancy connected to the compliant guide, wave height, current strength, and other conditions to plan the optimal shape of spoolable compliant guide 22.

In operation, shape monitoring system sub-module 104 interfaces with the dynamic positioning system sub-module 100 tracking surface vessel 28 to confirm the actual shape of compliant guide 22. The shape monitoring system sub-module 104 utilizes data from sensors 68, such as compliant guide sensors 70, which can be based on proven marine sensor technologies, such as ultrasonics, sonics, infrared and other types of sensors. Furthermore, umbilicals monitoring system sub-module 108 can obtain data from umbilical sensors 76 to monitor the position of one or more umbilicals used in the subsea intervention operation. Sub-module 108 can be used to indicate to an operator whether umbilicals are becoming tangled or if a moving cable is cutting into another cable or umbilical. The shape monitoring system sub-module 104 and umbilicals monitoring system sub-module 108 can be used in cooperation to monitor the position of umbilicals at different depths and to provide relevant alerts in the case of interference between cables and/or umbilicals. Shape monitoring system sub-module 104 also can interface with shape control system sub-module 106 in providing direct feedback regarding whether the programmed shape of the compliant guide 22 is actually obtained. As described in greater detail below, the shape control system sub-module 106 can be connected to a physical shape control system, such as a buoyancy based system or a tension cable system. Shape control sub-module 106 is then used to automatically actuate the shape control system to adjust the overall shape of compliant guide 22 to a more desirable configuration given the subsea environment and/or the status of the subsea intervention operation. The shape monitoring system sub-module 104 also can interface with well data module 102 and/or spoolable compliant guide stress, wear and fatigue planner and monitoring system module 94 to provide input on the intervention operation and on the actual geometry of compliant guide 22. This data is used in calculating the actual stresses and accumulated fatigue with respect to compliant guide 22.

Spoolable compliant guide stress, wear and fatigue planner and monitoring system module 94 is used to model the dynamic behavior of compliant guide 22. For example, module 94 can be used to model stresses experienced by compliant guide 22 in a specified configuration via, for example, a spoolable compliant guide dynamic model sub-module 110.

The module 94 also can be used to model accumulated fatigue, remaining life, predicted and actual wear experienced by compliant guide 22, and stresses induced in the compliant guide by conveyance 40. The data is processed via an appropriate spoolable compliant guide wear model sub-module 112 of the control system software.

Additionally, module 94 can utilize data obtained from module 90 and conveyance planner and monitoring system module 92 via, for example, spoolable compliant guide shape monitor sub-module 114 and conveyance monitoring system input sub-module 116. The data obtained is used to facilitate accurate prediction of the accumulated fatigue and wear based on the real history of intervention operations. System module 94 also can be used to calculate the surface vessel operating envelope for position, orientation, current, and wave heights when appropriate data is entered regarding intervention system components and operational parameters are appropriately measured by sensors 68. This data further allows system module 94 to define emergency disconnection limits in case of a drive-off scenario. In addition, system module 94 can be used to gather data, e.g. tension/compression, speed, depth covered, and other parameters, from conveyance system module 92 via, for example, conveyance sensors 74. The module can further interact with compliant guide sensors 70 to evaluate when compliant guide 22 is encountering problems or operating outside of the desired range. For example, sensors 70 may be used to measure compliant guide thickness, to detect the presence of faults, bumps, kinks, excessive stresses, or other parameters potentially detrimental to continued operation of the compliant guide.

Conveyance planner and monitoring system module 92 can be integrated into the overall control system 64. System module 92 includes, for example, a coiled tubing conveyance planner sub-module 118 that works in cooperation with a coiled tubing monitoring system sub-module 120. Additionally, module 92 may include a wireline conveyance planner sub-module 122 that works in cooperation with a wireline monitoring system sub-module 124. The module and sub-module software is designed to monitor parameters related to conveyance 40 to determine, for example, whether those parameters fall within desired ranges. The software also can be used to predict parameter values at various points of an intervention operation. For example, module 92 can be used to predict conveyance tension while running in-hole or pulling out-of-hole, to estimate friction, to estimate pressure forces, to estimate fluid dynamic forces, and to measure or predict other conveyance related parameters. System module 92 allows an operator to plan an intervention operation and facilitates the estimation of expected values for parameters measured by various sensors 68, thereby enabling real-time monitoring of the actual parameter values versus the planned values. Accordingly, conveyance planner and monitoring system module 92 can be used in cooperation with modules 90 and 94 to process the data collected by those modules.

Control system 64 also may utilize leak detection module 96 and a variety of compliant guide sensors 70 and/or other subsea sensors to detect leaks in the compliant guide 22. Examples of sensors deployed along compliant guide 22 include pressure sensors 126 ultrasonics sensors 128, infrared sensors 130, and/or fiber optic sensors 132. The leak detection module 96 can be particularly important in deep water where it can become impractical to monitor the entire intervention system with remotely operated vehicle cameras and where the time for a leak to appear at the surface would be excessive.

Leak detection module 96 also can be utilized in conjunction with pressure control system module 98. By way of example, pressure control system module 98 may comprise a pressure control sub-module 134, as well as an emergency disconnection system sub-module 136, a well pressure sensor sub-module 138, and a spoolable compliant guide pressure sensor sub-module 140 to monitor and process, for example, the output from various pressure sensors positioned along compliant guide 22 and subsea well installation 26. Based on data from the various pressure sensors, pressure control system module 98 can be used to output control instructions to the emergency disconnection controls via sub-module 136. Furthermore, leak detection module 96 also can be programmed to receive and utilize data from the pressure sensors otherwise used by pressure control system module 98.

Based on data received from the various sensor 68 and the processing of that data by control system 64, appropriate changes can be made to the configuration, i.e. shape of compliant guide 22. For example, the shape of compliant guide 22 can be changed to reduce stress, to prevent the occurrence of leaks, to facilitate internal movement of the intervention tool string and conveyance, and/or to facilitate the intervention operation in a variety of additional ways. Shape planner and monitoring system module 90 of control system 64 can be coupled to a physical shape control system 142 that is joined to compliant guide 22 in a manner allowing control system 64 (automatically or via an operator input) to adjust the compliant guide shape.

Figure 5:
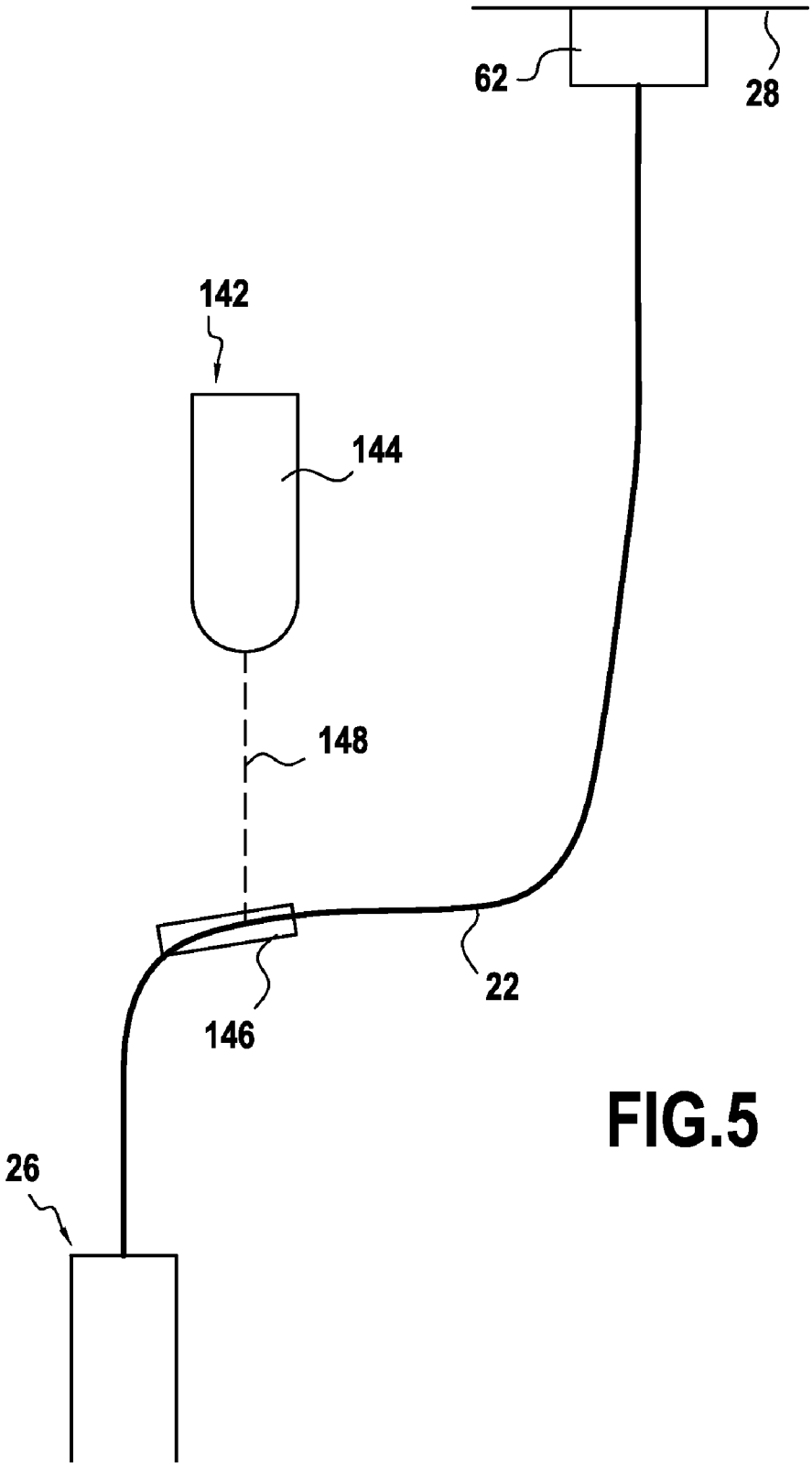
FIG. 5 is a schematic illustration of a compliant guide having a buoyancy mechanism, according to an embodiment of the present invention.

As illustrated in FIG. 5, one embodiment of shape control system 142 comprises a buoyancy element 144 coupled to a connection feature 146 on compliant guide 22. Buoyancy element 144 may be connected to feature 146 by a tether or other appropriate structure 148. The buoyancy of element 144 is controlled via the appropriately programmed system module 90 of control system 64. One or more of the buoyancy elements 144 can be attached at desired positions along compliant guide 22 to enable desired control over the configuration of the compliant guide. The buoyancy element 144 serves as a biasing element that is positioned to bias compliant guide 22 into a desired curvilinear shape.

Figure 6:
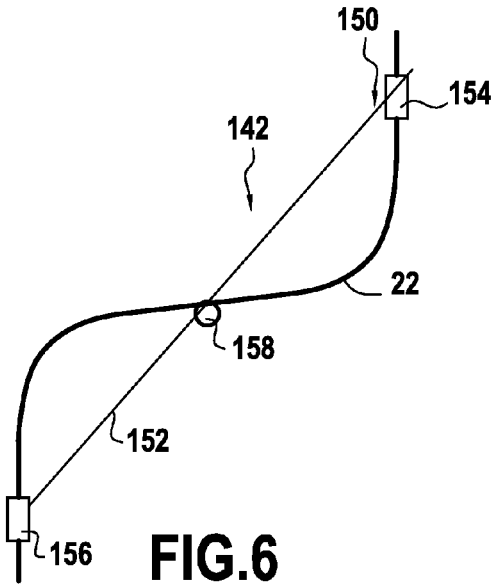
FIG. 6 is a schematic illustration of a compliant guide having a cable tensioning system, according to another embodiment of the present invention.
Figure 7:
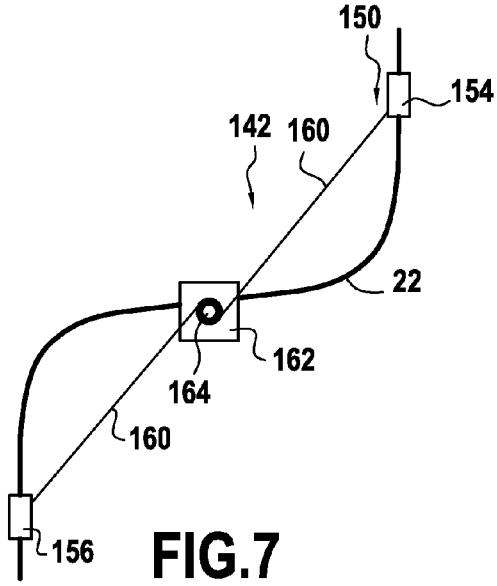
FIG. 7 is a schematic illustration of a compliant guide having a cable tensioning system, according to another embodiment of the present invention.
Figure 8:
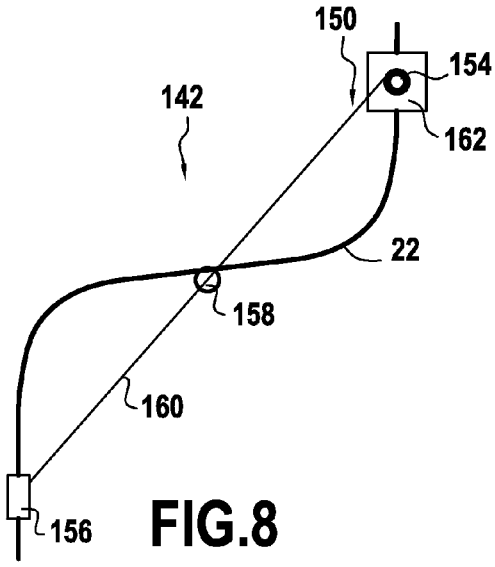
FIG. 8 is a schematic illustration of a compliant guide having a cable tensioning system, according to another embodiment of the present invention.

In an alternate embodiment, shape control system 142 may comprise a tensioned cable system 150, as illustrated in FIGS. 6-8. The shape of compliant guide 22 is controlled via system module 90 of control system 64 to place compliant guide 22 in a desired curvilinear shape, such as the desired "S" shape illustrated. The tensioned cable system 150 has an elastic or biasing element coupled to the compliant guide in a manner that allows compliant guide 22 to adapt to its desired shape during movements of surface vessel 28. The elastic element may comprise an elastic cable or rope 152, as illustrated in FIG. 6. The elastic cable 152 is coupled to opposed ends of compliant guide 22 by attachment features 154, 156 and at least slidingly to compliant guide 22 at an intermediate position via a retaining feature 158.

Additional embodiments of tensioned cable system 150 are illustrated in FIGS. 7 and 8. In these embodiments, the elastic element comprises a tension line 160 coupled to an elastic, e.g., spring-loaded, tensioning system 162 that may be located at an intermediate position (FIG. 7) or an end position (FIG. 8) along compliant guide 22. Tensioning system 162 may comprise a winch 164 that is controlled to draw in or release tension line 160. In any of the embodiments of FIGS. 6-8, the elastic element serves as a dampener for vibrations in the compliant guide and also can serve as a shock absorber during, for example, landing compliant guide 22 on subsea installation 26.

Figure 9:
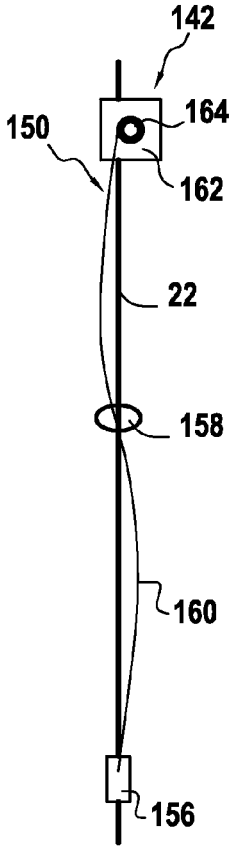
FIG. 9 is a schematic illustration of a compliant guide deployed with the cable tensioning system in a relaxed state, according to an embodiment of the present invention.
Figure 10:
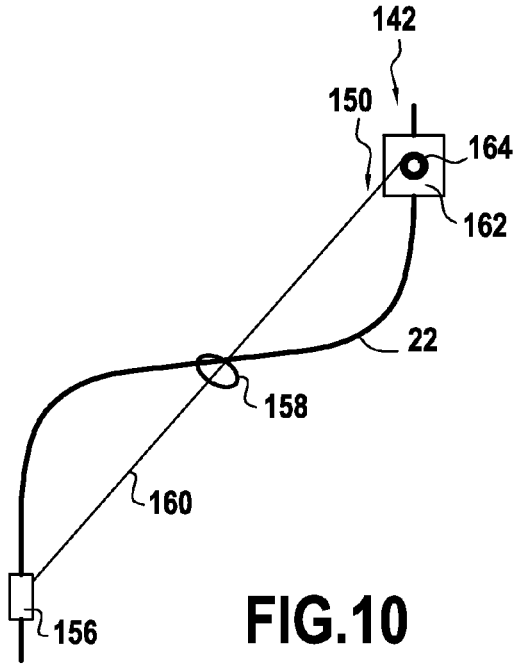
FIG. 10 is a schematic illustration similar to that of FIG. 9 but with the cable tensioning system in a spring-loaded state, according to an embodiment of the present invention.

Referring generally to FIGS. 9 and 10, one method of deploying compliant guide 22 and shape control system 142 is illustrated. In this embodiment, compliant guide 22 is run into the water in a generally straight configuration with tension line 160 attached but under no tension, as illustrated in FIG. 9. Retaining feature 158 holds tension line 160 close to compliant guide 22 along its middle section. When the compliant guide 22 and shape control system 142 have been deployed, winch 164 is activated to place tension in tension line 160 and to force the compliant guide 22 into a desired shape, e.g. an S-shape as illustrated in FIG. 10. Once the desired shape is achieved, winch 164 can be locked in place such that the spring-loaded tensioning system 162 allows elastic changes in the length of tension line 160. The elastic changes permit motion compensation changes of shape in the compliant guide while continually biasing the compliant guide 22 to the desired configuration.

The operation of intervention system 20 is improved with a variety of control systems, sensor systems, and shape control systems as described above. The specific type and arrangement of sensors, however, can be varied depending on the operation environment, operation equipment, and the goals of the operator. Additionally, the architecture of the control system 64, e.g. the content, number, arrangement, and interaction of software modules, can also vary depending on the types of sensors, types of intervention equipment components, operational environment, design specifications and other factors. Furthermore, the shape control system can utilize a variety of biasing elements that enable control over the shape of the compliant guide while allowing motion compensation.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A method to facilitate use of a spoolable compliant guide in a subsea intervention, comprising:

deploying a spoolable compliant guide between a subsea well installation and a surface position;

positioning a plurality of sensors at subsea positions to measure parameters related to operation of the spoolable compliant guide;

monitoring the parameters to detect the occurrence of an excess parameter deviation with respect to the spoolable compliant guide;

engaging a cable tensioning system with the spoolable compliant guide at a plurality of locations; and based on the parameters monitored, actuating the cable tension system to change the length of a cable between the plurality of locations and to thus change the shape of the spoolable compliant guide.

2. The method as recited in claim 1, wherein deploying comprises deploying the spoolable compliant guide between the subsea well installation and a surface vessel.

3. The method as recited in claim 2, wherein positioning comprises positioning sensors along the spoolable compliant guide and subsea well installation.

4. The method as recited in claim 2, wherein monitoring comprises monitoring stress along the spoolable compliant guide.

5. The method as recited in claim 2, wherein monitoring comprises monitoring pressure along the spoolable compliant guide.

6. The method as recited in claim 2, wherein monitoring comprises monitoring the shape of the spoolable compliant guide.

7. The method as recited in claim 2, wherein monitoring comprises monitoring the integrity of the spoolable compliant guide.

8. The method as recited in claim 2, further comprising adjusting the shape of the spoolable compliant guide based on the monitored parameters.

9. The method as recited in claim 2, further comprising monitoring a selected parameter of an umbilical utilized in the subsea intervention.

10. The method as recited in claim 1, further comprising maintaining the spoolable compliant guide in a generally S-shaped configuration.

11. The method as recited in claim 2, further comprising shaping the spoolable compliant guide with the cable tensioning system by a cable coupled to opposed ends of the spoolable compliant guide and slidingly coupled to the spoolable compliant guide at an intermediate position.

12. A system for use in a subsea intervention, comprising:

a spoolable compliant guide coupled between a subsea well installation and a surface vessel, the spoolable compliant guide being configured for movement of a conveyance therein;

a sensor system having sensors deployed in subsea locations to detect operational parameters related to operation of the spoolable compliant guide;

a control system to receive data output from the sensor system, the control system outputting an indicator when the operational parameters are outside of a desired range; and a cable tensioning system coupled to the spoolable compliant guide at opposite ends of the spoolable compliant guide and at an intermediate position to enable shape control of the spoolable compliant guide, wherein the cable tensioning system may be selectively actuated by the control system, based on data from the sensor system, to change the shape of the spoolable compliant guide.

13. The system as recited in claim 12, wherein the cable tensioning system is slideably coupled to the spoolable compliant guide at the intermediate position.

14. The system as recited in claim 12, wherein the cable tensioning system comprises a tensioning system mounted at the intermediate position and coupled with the opposite ends of the spoolable compliant guide via cable.

15. The system as recited in claim 14, wherein the tensioning system comprises a winch.

16. The system as recited in claim 12, wherein the cable tensioning system comprises a tensioning system mounted at one of the opposed ends and coupled with the intermediate position and the opposite opposed end via cable.

17. The system as recited in claim 12, wherein the sensor system monitors the integrity of the spoolable compliant guide.

18. The system as recited in claim 12, further comprising a plurality of umbilicals coupled to the subsea well installation, wherein the sensor system further comprises umbilical sensors.

19. A method of subsea intervention, comprising:

positioning a plurality of sensors at subsea locations to measure parameters related to a compliant guide coupled between a subsea well installation and a surface vessel;

monitoring output from the plurality of sensors with a control system; and adjusting the configuration of the compliant guide based on evaluation of the parameters by the control system, wherein adjusting comprises changing the shape of the spoolable compliant guide with a buoyancy element coupled to the spoolable compliant guide at an intermediate position via a tether extending between the buoyancy element and a connection feature on the spoolable compliant guide.

20. The method as recited in claim 19, further comprising deploying a conveyance through the compliant guide.

21. The method as recited in claim 20, further comprising monitoring conveyance parameters with the control system.

22. The method as recited in claim 21, wherein adjusting comprises moving the surface vessel.

23. The method as recited in claim 19, further comprising utilizing the control system to determine leaks in the compliant guide.

24. The method as recited in claim 19, further comprising utilizing the control system to monitor the shape of the compliant guide.

25. A system for use with the compliant guide, comprising:

a shape control system having at least one attachment feature by which the shape control system is coupleable to the compliant guide, the shape control system comprising a biasing element positioned to bias the compliant guide into a curvilinear shape when the shape control system controls the shape of the compliant guide, wherein the biasing element comprises a tension cable coupled to the compliant guide at a plurality of locations, the tensioned cable being adjustable in length via a winch mounted on the spoolable compliant guide such that actuation of the winch changes the shape of the spoolable compliant guide.

26. The system as recited in claim 25, wherein the tensioned cable comprises an elastic cable.

* * * * *